US008777441B2

(12) United States Patent
Vazquez

(10) Patent No.: US 8,777,441 B2
(45) Date of Patent: Jul. 15, 2014

(54) THERMOELECTRIC ORNAMENTAL ASSEMBLY

(76) Inventor: Patrick Vazquez, Ewa Beach, HI (US)

( * ) Notice: Subject to any disclaimer, the term of this patent is extended or adjusted under 35 U.S.C. 154(b) by 211 days.

(21) Appl. No.: 13/587,824

(22) Filed: Aug. 16, 2012

(65) Prior Publication Data

US 2014/0049950 A1 Feb. 20, 2014

(51) Int. Cl.
*F21L 13/00* (2006.01)

(52) U.S. Cl.
USPC ..... 362/157; 362/192; 362/104

(58) Field of Classification Search
USPC ..... 362/571, 157, 565, 104, 103, 192, 806; 63/1.11, 1.13
See application file for complete search history.

(56) References Cited

U.S. PATENT DOCUMENTS

| | | | | |
|---|---|---|---|---|
| 3,790,775 | A | 2/1974 | Rosenblatt | |
| 4,012,629 | A | 3/1977 | Simms | |
| 4,093,973 | A | 6/1978 | Vaagenes | |
| 5,519,591 | A | 5/1996 | McCrary | |
| 5,622,062 | A | 4/1997 | Gong-Hwa | |
| 5,653,524 | A | 8/1997 | Gray | |
| 6,050,695 | A | 4/2000 | Fromm | |
| 7,367,684 | B2 | 5/2008 | D'Souza | |
| 7,431,478 | B2 * | 10/2008 | Lee | 362/294 |
| 7,703,937 | B2 | 4/2010 | Shirey | |
| 8,497,515 | B1 * | 7/2013 | Sagal | 257/79 |
| 2002/0131266 | A1 | 9/2002 | Naghi | |
| 2004/0037067 | A1 | 2/2004 | Elwonger | |
| 2010/0012165 | A1 * | 1/2010 | Bedard | 136/205 |
| 2013/0021788 | A1 * | 1/2013 | Mayes | 362/183 |

* cited by examiner

*Primary Examiner* — Bao Q Truong
(74) *Attorney, Agent, or Firm* — Ariel S. Bentolila; Bay Area IP, llc

(57) ABSTRACT

A thermoelectric ornamental assembly for generating thermoelectric energy in a body adornment like a ring. The assembly uses a thermoelectric effect to generate an applied temperature gradient between an inner layer and an outer layer of the ring. The inner layer both receives and transmits a thermal current away from the skin. The outer layer receives the thermal current. Electrons diffuse from the inner layer, which is a warm, excited electron area, to the outer layer, which is a cool, less excited electron area. This gradient creates the thermal current. A thermoelectric layer is sandwiched between the outer and inner layer. The thermoelectric layer includes a substrate portion that supports variably doped semiconductors for creating a difference in conductivity so that the charge carriers can diffuse and create a voltage across the thermoelectric portion. The voltage produces a light visible through a transparent area of the ring.

20 Claims, 2 Drawing Sheets

THERMOELECTRIC ORNAMENTAL ASSEMBLY

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to thermoelectric effects. More particularly, one or more embodiments of the invention relate to thermoelectric effects in body adornments.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that the thermoelectric effect is the direct conversion of temperature differences to electric voltage and vice-versa. A thermoelectric device creates a voltage when there is a different temperature on each side. Conversely, when a voltage is applied, a temperature difference is generated.

Typically, jewelry is a form of personal adornment, such as brooches, rings, necklaces, earrings, and bracelets. By providing two distinct surfaces on the jewelry capable of distinguishing different temperature gradients, a thermoelectric illuminating, or power generating effect is created in proximity to the jewelry.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
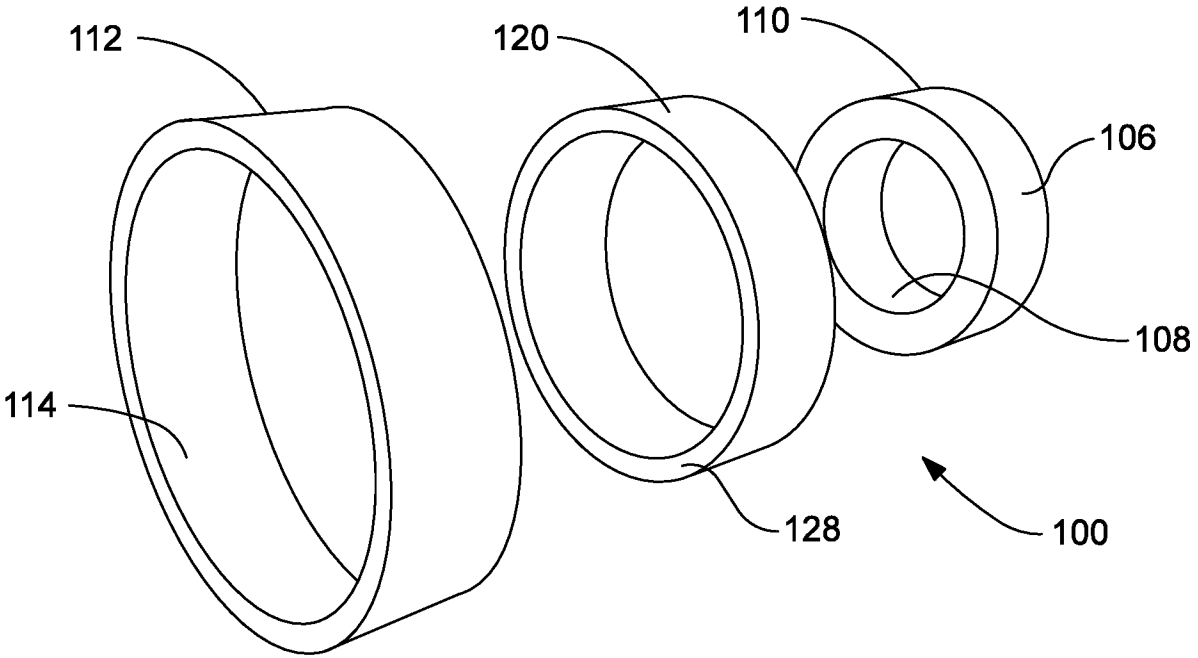
FIG. 1 illustrates a detailed perspective view of an exemplary thermoelectric ornamental assembly, in accordance with an embodiment of the present invention.

Unless otherwise indicated illustrations in the figures are not necessarily drawn to scale.

DETAILED DESCRIPTION OF SOME EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

The present invention will now be described in detail with reference to embodiments thereof as illustrated in the accompanying drawings.

There are various types of thermoelectric ornamental assemblies 100 that may be provided by preferred embodiments of the present invention. In some embodiments, the thermoelectric ornamental assembly 100 may generate thermoelectric energy in an annular body adornment. Those skilled in the art, in light of the present teachings, will recognize that in the thermoelectric effect, an applied temperature gradient may cause a multiplicity of charge carriers 102 in a material to diffuse from an excited electron area (warm) to a less excited electron area (cool); hence inducing a thermal current 104. Similarly, the thermoelectric ornamental assembly may utilize the difference in temperature between the warmer skin and the cooler ambience temperature to directly converse the temperature gradients into electrical power. In this manner, the body adornment may exhibit ornamental and functional features from self-generated electricity, including, without limitation, illumination and a portable power source.

In some embodiments, the thermoelectric ornamental assembly may include an inner dermal portion 106 that may contact a dermal area 200 for extended periods of time. The dermal portion may serve as a conductor for the thermal current originating in the dermal area. The dermal portion may include an inner mounting surface 108 for joining and maintaining contact with the dermal area. The dermal portion may further include an outer charge carrier donor surface 110 for diffusing the thermal current away from the dermal area. In some embodiments, the thermoelectric ornamental assembly may further include a display portion 112 for receiving the thermal current and exhibiting the ornamental and functional effects of electrical power. In some embodiments, ornamental members, including, without limitation, precious metals, precious stones, semi-precious stones, pearls, shapes, figures, text, and graphics may overlay the display portion. The display portion may include a charge carrier receiver surface 114 for receiving the thermal current.

In some embodiments, a thermoelectric portion 120 may position between the dermal portion and the display portion, whereby a voltage may be created by the different temperatures on each side of the thermoelectric portion. The thermoelectric portion may incorporate into a substrate portion 122 for providing a material upon which electronic devices may be deposited and the thermoelectric effect may occur. The thermoelectric portion may utilize the difference in temperature between the dermal portion and the display portion to produce a current by receiving the thermal current from the dermal contact portion, and diffusing the thermal current onto the display portion. The thermoelectric portion may use the temperature difference to generate electrical power. Those skilled in the art will also recognize that the thermoelectric portion may utilize various types of thermoelectric effects, including, without limitation, a Seebeck effect, a Peltier effect, or a Thomson effect. In some embodiments, the substrate portion may support a multiplicity of variably doped semiconductors 124 for creating a difference in conductivity so that the charge carriers may diffuse and create a voltage across the thermoelectric portion. The doped semiconductors may include, without limitation, at least one N-type semiconductor portion for providing the charge carriers from the dermal contact portion, and at least one P-type semiconductor portion for receiving the charge carriers from the at least one N-type semiconductor portion; thereby creating an electrical current and the thermal current. In some embodiments, at least one conductor portion 126 may join each variably doped semiconductor to provide a conduit for the charge carriers. In some embodiments, the at least one electrical conductor portion may provide a junction that allows thermal energy to flow between the three portions. The at least one conductor portion may also positions between the thermoelectric portion and the dermal portion; and the thermoelectric portion and the display portion. In some embodiments, the thermoelectric portion, the dermal portion, and the display portion may include a transparent surface portion 128 for allowing illumination to pass through. The transparent surface portion may include an LED or a gas for actuating the illumination.

FIG. 1 illustrates a detailed perspective view of an exemplary thermoelectric ornamental assembly, in accordance with an embodiment of the present invention. In some embodiments, the thermoelectric ornamental assembly may include a multi-layered annular shaped body adornment that positions onto a ring finger. However, in other embodiments, the thermoelectric ornamental assembly may include a body adornment that has at least one surface that is in contact with the dermal area for an extended period of time. In this manner, the body adornment may exhibit ornamental and functional features from the generated electricity, including, without limitation, illumination and a portable source for power. For example, without limitation, a wedding ring that generates a subtle illumination (LED) beneath the diamond to enhance the diamond's brilliance; a self-powered watch; 3-D visualizations and models; through the use of capacitors, a ring light that generates powerful bursts of illumination in short periodic intervals, strip of lights worn on garments across body or under the skin; light-up armbands; light-up shoes; low powered communication devices such as Bluetooth headsets; OLED, LED, PLASMA, or any other display worn on the body; essentially anything electronic warn on the body that is powered by the body's own heat or through the use of a combination of thermoelectric and solar power. Those skilled in the art, in light of the present teachings, will recognize that when the ambience temperature is higher than that of the dermal area, the thermoelectric ornamental assembly may stop generating power. The thermoelectric ornamental assembly may not operate if user's surroundings are hotter than 98.6 degrees Fahrenheit. However, when the thermoelectric ornamental assembly is in a dark area the outside may be cooler than 98.6 degrees Fahrenheit. In some embodiments, the day light may inhibit viewing a subtle illumination. In one alternative embodiment, the illumination may generate a holographic visualization of a precious or semi-precious stone.

In some embodiments, the thermoelectric ornamental assembly may include an inner dermal portion for conducting the thermal current from the dermal area to the thermoelectric portion. In some embodiments, the dermal area may include a ring finger, a chest, an ankle, and the like. However, any area of the body that is in extended contact with the dermal portion may serve to create the thermoelectric effect. Those skilled in the art, in light of the present teachings, will recognize that the dermal portion should comprise a material suitable for conductivity, including, without limitation, ceramics, metals, copper, semiconductors, and the like. The dermal portion may include a mounting surface for joining with the dermal area for extended periods of time. The dermal portion may further include a charge carrier donor surface for diffusing the thermal current. In some embodiments, the dermal portion may include the inner surface of a ring, while the exterior charge carrier donor surface may include an exterior surface of the ring that maintains contact with the thermoelectric portion. In some embodiments, the thermoelectric ornamental assembly may further include an exterior display portion for receiving the thermal current and exhibiting the ornamental and functional effects of electrical power. In some embodiments, ornamental members, including, without limitation, precious metals, precious stones, semi-precious stones, pearls, shapes, figures, text, and graphics may overlay the display portion. The display portion may include a charge carrier receiver surface for receiving the thermal current from the thermoelectric portion. In some embodiments, the temperature gradient between the dermal portion and the display portion may generate the thermoelectric effect. Those skilled in the art, in light of the present teachings, will recognize that the unique characteristics of thermoelectric science may create a portable, electronic article of jewelry that does not require a power source, such as a battery, and has a long service life due to the minimal utilization of moving parts and fragile or disposable materials. In one alternative embodiment, the power source may include a solar power panel.

Figure 2:
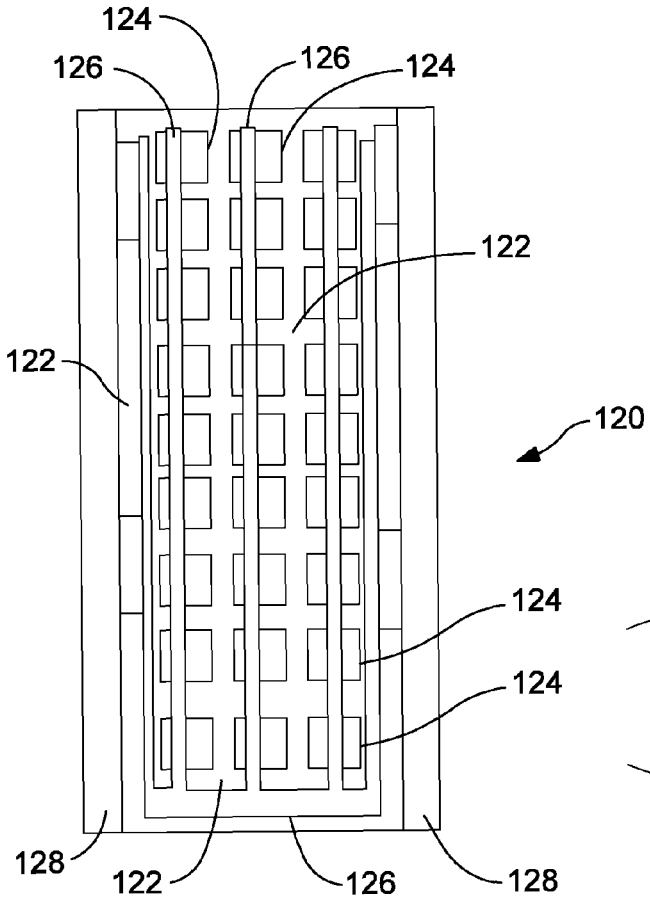
FIG. 2 illustrates a sectioned view of an exemplary thermoelectric portion, in accordance with an embodiment of the present invention.

FIG. 2 illustrates a sectioned view of an exemplary thermoelectric portion, in accordance with an embodiment of the present invention. In some embodiments, the thermoelectric portion may include an annular shape that positions between the dermal portion and the display portion, whereby a voltage may be created by the different temperatures on each side of the thermoelectric portion. In some embodiments, the substrate portion may serve as the foundation upon which electronic devices, including, without limitation, semiconductors, capacitors, transistors, diodes, and integrated circuits are deposited, and the thermoelectric effect occurs. The substrate portion may provide the physical material upon which the charge carriers diffuse from the warmer dermal portion to the cooler display portion. In one embodiment, the substrate portion may position between the dermal contact portion and the display portion to act as a bridge for the charge carriers. Suitable materials for the substrate portion may include, without limitation, ceramics, silicon, silicon dioxide, aluminum oxide, sapphire, germanium, gallium arsenide, an alloy of silicon and germanium, and indium phosphide.

In one alternative embodiment, the thermoelectric ornamental assembly may include only a dermal portion and a thermoelectric portion, whereby the thermoelectric portion replaces the display portion as the exterior display of the thermoelectric ornamental assembly. In this manner, the thermal current may diffuse directly from the dermal area to the exterior portion of the thermoelectric portion for generating the illumination. However, this alternative embodiment may further require a nonconductive thermal layer positioned between the dermal portion and the thermoelectric portion to temper the flow of the thermal current between the two.

In some embodiments, the thermoelectric portion may utilize the difference in temperature between the dermal portion and display portion to produce an electrical current by receiving the thermal current from the dermal contact portion, and diffusing the thermal current onto the display portion. The thermoelectric portion may use this difference in temperature to generate electrical power. In some embodiments, the thermoelectric portion may include a thermal current that is proportional to the temperature differences. In some embodiments, a power of 20 Watts or more may be generated by the thermoelectric portion. However, in other embodiments, lesser and greater amounts of power may be generated depending on the size, shape, and efficiency of the thermoelectric portion. Those skilled in the art will also recognize that the thermoelectric portion may utilize various types of thermoelectric effects, including, without limitation, a Seebeck effect, a Peltier effect, or a Thomson effect. Those skilled in the art, in light of the present teachings, will recognize that the Seebeck effect may be ideal for the thermoelectric ornamental assembly, whereby an electromotive force and consequently an electric current in a loop of the thermoelectric portion may include at least two dissimilar conductor portions. When the at least two dissimilar conductor portions are maintained at different temperatures, they respond differently to the temperature difference, thereby creating a current loop and a magnetic field in the thermoelectric portion. However, in other embodiments, a Peltier junction thermoelectric device working in reverse may be utilized with the thermoelectric ornamental assembly, whereby the presence of heat at an electrified conductor portion of two different metals is generated at an upper conductor portion, and absorbed at a lower conductor portion to create the thermoelectric effect. In one alternative embodiment, a generated voltage may excite a gas inside the transparent surface portion to generate illumination. The gas may include, without limitation Neon, Argon, Krypton, and Xenon.

In some embodiments, the substrate portion may support a multiplicity of variably doped semiconductors for creating a difference in conductivity so that the charge carriers may diffuse and create a voltage across the thermoelectric portion. The doped semiconductors may include, without limitation, at least one N-type semiconductor portion for providing the charge carriers from the dermal contact portion, and at least one P-type semiconductor portion for receiving the charge carriers from the at least one N-type semiconductor portion; thereby creating the electrical and thermal current across the thermoelectric portion. In some embodiments, both P-type and N-type semiconductor portions may be fabricated from alloys, including, without limitation, Bismuth and Tellurium. However, in other embodiments, other semiconductor materials efficacious for improving the efficiency of the thermoelectric effect may be utilized that are now known or later developed. In yet another embodiment, the P-type semiconductor portion and the N-type semiconductor portion may join electrically in series and thermally in parallel within the substrate portion. In some embodiments, at least one conductor portion may join each variably doped semiconductor to provide a conduit for the charge carriers. When at least two dissimilar conductor portions are maintained at different temperatures, they respond differently to the temperature difference, thereby creating a current loop and a magnetic field through the thermoelectric portion. In some embodiments, the at least one electrical conductor portion may provide a junction that allows thermal energy to flow between the three portions. The at least one conductor portion may also positions between the thermoelectric portion and the dermal portion; and the thermoelectric portion and the display portion. Those skilled in the art, in light of the present teachings, will recognize that when at least two dissimilar conductor portions are maintained at different temperatures, they respond differently to the temperature difference, thereby creating a current loop and a magnetic field through the thermoelectric portion.

Those skilled in the art, in light of the present teachings, will recognize that the P-type and N-type semiconductor portions may hold different free charge carrier densities at the same temperature. This phenomenon, called the Seebeck effect, is what drives the thermoelectric effect. When the P-type and N-type semiconductors are placed in contact, the charge carriers flow from the N-type semiconductor to the P-type semiconductor if the energy levels of the charge carriers are different in the two semiconductors. The higher energy charge carriers cross the at least one conductor portion until the energy levels are the same for each type of semiconductor. In some embodiments, the thermoelectric portion may include the N-type semiconductor and the P-type semiconductor whose energy levels change at different rates when there is a variance in temperature. Hence, if the at least one conductor portion is not at the same temperature as the semiconductors, there are unequal differences in energy levels across the at least one conductor portion. Thus, unequal numbers of charge carriers have to cross the at least one conductor portion and unequal voltages are established, thereby creating the electrical and thermal current.

In one alternative embodiment, a battery may be used in conjunction with the thermoelectric portion to increase the amount of electrical power generated. The battery may provide a longer period of usage because it is not providing the full amount of power. However, in another alternative embodiment, a multiplicity of thermoelectric ornamental assemblies may be joined in series or parallel to increase the electrical power. In yet another alternative embodiment, a multiplicity of electrical devices, including, without limitation, capacitors, resistors, diodes, and circuit boards may be included in the thermoelectric ornamental assembly to provide variable and enhanced electrical power functions.

Figure 3:
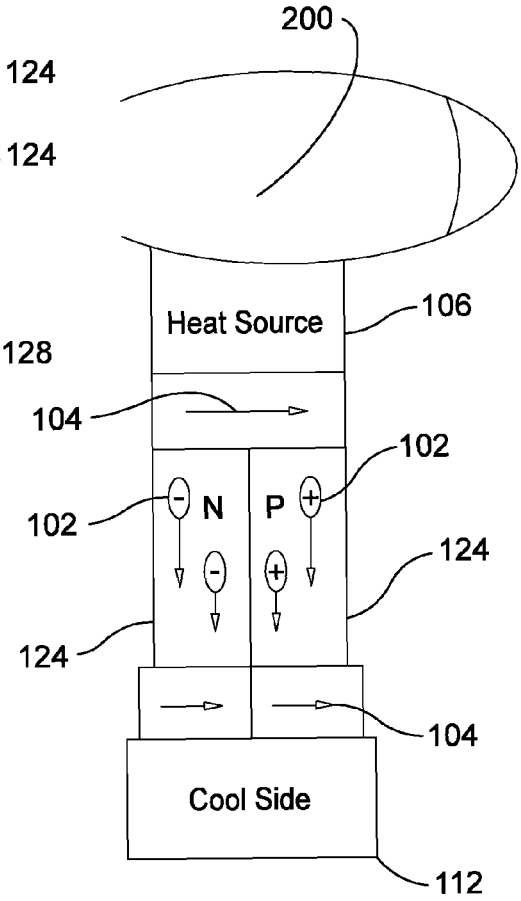
FIG. 3 illustrates a detailed perspective view of an exemplary thermoelectric portion positioned on an exemplary warm dermal area, in accordance with an embodiment of the present invention.

FIG. 3 illustrates a detailed perspective view of an exemplary thermoelectric portion positioned on an exemplary warm dermal area, in accordance with an embodiment of the present invention. In some embodiments, the thermoelectric portion, the dermal portion, and the display portion may include a transparent surface portion for allowing illumination to pass through. The transparent surface portion may include an LED or a gas for actuating the illumination, whereby the electrical and thermal current generated in the thermoelectric portion may create sufficient electrical power to actuate the LED, or excite the gas to a sufficiently high energy level for generating illumination. Suitable materials for fabricating the transparent surface portion may include, without limitation, a clear plastic, a clear acrylic, silicon, glass, and the like.

In one alternative embodiment, the thermoelectric ornamental assembly may include outlets and wires to transmit power to a separate portable electronic device. In yet another alternative embodiment, the thermoelectric ornamental assembly may be used to power a miniature processor located inside the thermoelectric ornamental assembly for monitoring and displaying the heart's pulse from the wrist, head, or leg. In yet another alternative embodiment, the thermoelectric ornamental assembly may be used to power an audio device for alerting the user to a desired event, including, without limitation, a news bulletin, a financial transaction trigger, a telephone call, a text, an email, and a global positioning system.

All the features or embodiment components disclosed in this specification, including any accompanying abstract and drawings, unless expressly stated otherwise, may be replaced by alternative features or components serving the same, equivalent or similar purpose as known by those skilled in the art to achieve the same, equivalent, suitable, or similar results by such alternative feature(s) or component(s) providing a similar function by virtue of their having known suitable properties for the intended purpose. Thus, unless expressly stated otherwise, each feature disclosed is one example only of a generic series of equivalent, or suitable, or similar features known or knowable to those skilled in the art without requiring undue experimentation.

Having fully described at least one embodiment of the present invention, other equivalent or alternative methods of implementing thermoelectric effects in body adornments according to the present invention will be apparent to those skilled in the art. Various aspects of the invention have been described above by way of illustration, and the specific embodiments disclosed are not intended to limit the invention to the particular forms disclosed. The particular implementation of the thermoelectric effects in body adornments may vary depending upon the particular context or application. By way of example, and not limitation, the thermoelectric effects in body adornments described in the foregoing were principally directed to illuminating rings implementations; however, similar techniques may instead be applied to clothing and garments that utilize the thermoelectric effect, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A thermoelectric ornamental assembly comprising:

a dermal portion, said dermal portion being configured to contact a dermal area, said dermal portion comprising a mounting surface, said mounting surface being configured to engage said dermal area, said dermal portion further comprising a charge carrier donor surface, said charge carrier donor surface being operable to diffuse a thermal current away from said dermal area;

a display portion, said display portion being operable to receive said thermal current, said display portion further being operable to display an ornamental effect, said display portion comprising a charge carrier receiver surface, said charge carrier receiver surface being operable to receive said thermal current from said dermal area;

a thermoelectric portion, said thermoelectric portion being disposed to position between said dermal portion and said display portion, said thermoelectric portion being operable to generate a voltage from a temperature variance between said dermal portion and said display portion, said thermoelectric portion comprising a substrate portion, said substrate portion being configured to provide a material surface for supporting a multiplicity of charge carriers, said thermoelectric portion further comprising a multiplicity of variably doped semiconductors, said multiplicity of variably doped semiconductors being operable to create a voltage across said thermoelectric portion, said thermoelectric portion further comprising at least one conductor portion, said at least one conductor portion being configured to provide a conduit for said multiplicity of charge carriers; and a transparent surface portion, said transparent surface portion being configured to allow illumination to pass through.

2. The thermoelectric ornamental assembly of claim 1, wherein said thermoelectric ornamental assembly is operable to generate a thermoelectric effect.

3. The thermoelectric ornamental assembly of claim 2, in which said thermoelectric effect comprises a Seebeck effect.

4. The thermoelectric ornamental assembly of claim 3, wherein said thermal current is operable to generate said voltage.

5. The thermoelectric ornamental assembly of claim 4, wherein said voltage is configured to be proportional to a temperature difference between said dermal portion and said display portion.

6. The thermoelectric ornamental assembly of claim 5, wherein said voltage is operable to generate said illumination.

7. The thermoelectric ornamental assembly of claim 6, in which said multiplicity of charge carriers comprises a multiplicity of electrons.

8. The thermoelectric ornamental assembly of claim 7, wherein said multiplicity of variably doped semiconductors are operable to create a difference in conductivity.

9. The thermoelectric ornamental assembly of claim 8, wherein said difference in conductivity is operable to diffuse said multiplicity of charge carriers for generating said voltage across said thermoelectric portion.

10. The thermoelectric ornamental assembly of claim 9, in which said multiplicity of variably doped semiconductors comprise at least one N-type semiconductor.

11. The thermoelectric ornamental assembly of claim 10, in which said multiplicity of variably doped semiconductors comprise at least one P-type semiconductor.

12. The thermoelectric ornamental assembly of claim 11, in which said substrate portion comprises a material for positioning at least one electronic device.

13. The thermoelectric ornamental assembly of claim 12, in which said substrate portion comprises said multiplicity of variably doped semiconductors.

14. The thermoelectric ornamental assembly of claim 13, in which said substrate portion comprises silicon.

15. The thermoelectric ornamental assembly of claim 14, in which said thermoelectric ornamental assembly comprises a solid state device.

16. The thermoelectric ornamental assembly of claim 15, in which said thermoelectric ornamental assembly comprises an annular shape.

17. The thermoelectric ornamental assembly of claim 16, in which said transparent surface portion comprises an acrylic ring.

18. The thermoelectric ornamental assembly of claim 17, in which said transparent surface portion comprises a light emitting diode.

19. A thermoelectric ornamental assembly method comprising:

means for adorning a thermoelectric ornamental assembly;

means for generating thermal energy on a dermal portion;

means for generating a thermal current between said dermal portion and said display portion;

means for providing a conduit for said thermal current on a thermoelectric portion;

means for generating a voltage in said thermoelectric portion; and means for generating an illumination in a transparent surface portion.

20. A thermoelectric ornamental assembly consisting of:

a dermal portion, said dermal portion being configured to contact a dermal area, said dermal portion comprising a ring, said dermal portion further comprising a mounting surface, said mounting surface being configured to engage said dermal area, said dermal portion further comprising a charge carrier donor surface, said charge carrier donor surface being operable to diffuse a thermal current away from said dermal area;

a display portion, said display portion being operable to receive said thermal current, said display portion further being operable to display an ornamental effect, said display surface comprising an annular ring, said display portion further comprising a charge carrier receiver surface, said charge carrier receiver surface being operable to receive said thermal current from said dermal area;

a thermoelectric portion, said thermoelectric portion being disposed to position between said dermal portion and said display portion, said thermoelectric portion being operable to generate a voltage from a temperature variance between said dermal portion and said display portion, said thermoelectric portion comprising a substrate portion, said substrate portion being configured to provide a material surface for supporting a multiplicity of charge carriers, said substrate portion comprising said multiplicity of variably doped semiconductors, said substrate portion comprising silicon, said multiplicity of charge carriers comprising a multiplicity of electrons, said thermoelectric portion further comprising a multiplicity of variably doped semiconductors, said multiplicity of variably doped semiconductors being operable to create a voltage across said thermoelectric portion, said multiplicity of variably doped semiconductors comprising at least one N-type semiconductor, said multiplicity of variably doped semiconductors comprising at least one P-type semiconductor, said thermoelectric portion further comprising at least one conductor portion, said at least one conductor portion being configured to provide a conduit for said multiplicity of charge carriers; and a transparent surface portion, said transparent surface portion being configured to allow illumination to pass through, said transparent surface portion comprising an acrylic ring, said transparent surface portion further comprising a light emitting diode.

* * * * *